United States Patent [19]

Primeau

[11] Patent Number: 5,000,411

[45] Date of Patent: Mar. 19, 1991

[54] MODULAR HOOK SUPPORT ASSEMBLY

[75] Inventor: Mario Primeau, Montreal, Canada

[73] Assignee: Groupe Sodepro Inc., Suite 707

[21] Appl. No.: 452,057

[22] Filed: Dec. 18, 1989

[30] Foreign Application Priority Data

Aug. 10, 1989 [CA] Canada ..... 6080499

[51] Int. Cl.[5] ..... A47B 96/06

[52] U.S. Cl. ..... 248/223.4; 248/225.2

[58] Field of Search ..... 248/223.4, 224.4, 225.2, 248/220.2, 231.91, 222.1, 223.3; 211/16, 105, 123

[56] References Cited

U.S. PATENT DOCUMENTS

| | | | |
|---|---|---|---|
| 42,033 | 3/1864 | Walker . | |
| 1,599,653 | 9/1926 | Cranston . | |
| 1,848,937 | 3/1932 | Conventry . | |
| 2,103,106 | 12/1937 | Yurkovitch . | |
| 2,141,347 | 12/1938 | Davis | 211/105.1 |
| 2,504,741 | 4/1950 | Simpson | 211/123 |
| 2,640,671 | 6/1953 | Grady | 211/105.1 X |
| 2,858,995 | 11/1958 | Sarro | 211/123 X |
| 3,260,021 | 7/1966 | Katz | 211/105.1 X |
| 3,270,996 | 9/1966 | Churchill et al. . | |
| 3,928,894 | 12/1975 | Bury et al. | 248/223.4 X |
| 4,320,935 | 3/1982 | Nagelkirk | 248/223.4 X |
| 4,372,450 | 2/1983 | Licari et al. | 211/87 |
| 4,718,625 | 1/1988 | Boda | 248/225.2 X |

*Primary Examiner*—Ramon O. Ramirez

*Attorney, Agent, or Firm*—Pierre Lesperance

[57] ABSTRACT

A modular plate assembly for hanging articles on a wall, comprising at least one and preferably a number of releasably interconnected plates, to be screwed on a wall, and at least one hook bracket, to be secured to the plates while concurrently hiding the head of the screw. The plates are endwisely interconnected in pairs by a tenon and mortise joint, including short hollow studs from one end section of one plate to frictionally engage large bores in one section of another plate. The screws engage through the hollow of the studs, to be driven into the wall. The hook bracket has a cavity provided with a railing, and each end of the plates has a tab whereby two proximate tabs from two adjacent plates are designed to be frictionally releasable engaged through the cavity of the hook bracket, to retain same in position for supporting the load of said article.

15 Claims, 4 Drawing Sheets

MODULAR HOOK SUPPORT ASSEMBLY

FIELD OF THE INVENTION

This invention relates to multi-purpose hangers, particularly of the modular type.

BACKGROUND OF THE INVENTION

It is known to provide wall hangers and support plate combinations whereby the hangers may be released from the support plate and interchanged when not in use: see U.S. Pat. No. 1,848,937 issued to Grey Iron Casting Company, U.S. Pat. No. 2,103,106 to Anton Yurkovitch or the recent U.S. Pat. No. 4,372,450 in the name of Basic Line, inc.

It is also known to provide wall hangers or shelves and support plates combinations whereby the assembly is of modular construction: the horizontal length thereof may be extended dependent upon the need, the available area and the number of articles to be supported or hung: see U.S. Pat. No. 1,599,653 to Cranston.

However, a common problem to known wall hangers is the clearance in front of the wall when the hanger is in use, i.e. mounted to its support plate on the wall. Also, the support plate, when the hanger is not connected thereto, still tends to require some relatively large clearance in front of the wall, thus precluding effective use of available space for other purposes. Moreover, these wall support plates, which are usually outwardly anchored to the wall by screws driven thereinto, show off the screw heads which outwardly project therefrom: this is not only aesthetically unacceptable, but could also produce injuries to persons sliding their hand/limb against the surface of the hangerless plate. Still another drawback of prior art is that modular hangers are not very effective in their visual appeal and in space utilization.

OBJECTS OF THE INVENTION

The object of the invention is to provide a wall hanger of the modular type, which will need very small front clearance from the supporting wall.

An object of the invention is to provide a hanger and associate support plate to be anchored to a wall by screws, whereby each screw head is hidden from view by a corresponding hanger.

Another object of the invention is to provide such a hanger and plate combination, which will be of low manufacturing cost.

SUMMARY OF THE INVENTION

In accordance with the objects of the invention, there is disclosed a modular plate assembly for hanging articles on a wall, comprising at least one and preferably a number of releasably interconnected plates, to be screwed on a wall, and at least one hook bracket, to be secured to the plates while concurrently hiding the head of the screw. The plates are endwisely interconnected in pairs by a tenon and mortise joint, including short hollow studs from one end section of one plate to frictionally engage large bores in one section of another plate.

The screws engage through the hollow of the studs, to be driven into the wall. The hook bracket has a cavity provided with a railing, and each end of the plates has a tab whereby two proximate tabs from two adjacent plates are designed to be frictionally releasably engaged through the cavity of the hook bracket, to retain same in position for supporting the load of said article.

Generally speaking, it is envisioned that the support be made from a substantially rigid plastic material by injection molding.

One preferred embodiment of the invention includes a support assembly for hangingly supporting an article against a wall, comprising:

(a) a support member having a through-bore, for passage of a screw member to be driven into said wall for anchoring said support member thereto;

(b) a hook member, for supporting said article; and (c) anchor means, for releasably anchoring said hook member to said support member, and coming in register with the head of said screw member to completely cover the latter, and defining: first rail means, mounted to said hook member, second rail means, mounted to said support member and slidably releasably engaging said first rail means, and stop means to prevent said second rail means from releasing said first rail means upon the load of said article to be hung being applied to said hook member.

Advantageously, said support member would then include two support plates, respectively having first and second mating ears, said first ear having at least one short transverse hollow stud, said second ear having at least one large aperture slidably releasably engaged by said stud, the hollow of said stud constituting said support member through-bore.

Said hook member could preferably be either one of the following elements:

(a) a U-shape coat-hanger bracket, said first rail means being mounted into a cavity made in one leg of said U-hook member;

(b) a generally L-shaped toilet paper support bracket, defining an elongated upstanding leg to be engaged by a roll of toilet paper and a short leg, said first rail means being mounted into a cavity made into the free end of said short leg; or (c) a towel supporting bar, of generally U-shape defining an elongated leg and two short legs, there being two said support members, spacedly anchored to said wall, said first rail means being mounted into a cavity made into the free end of each of said short legs. In each case, the cavity defines a mouth opening downwardly.

A second preferred embodiment of the invention would include a support for hangingly supporting an article against a wall, comprising:

(a) a first elongated support plate, defining two opposite ends;

(b) first and second ears, projecting from said ends respectively, said first ear having at least one large bore, said second ear having at least one short transverse hollow stud;

(c) a second support end plate, having a third ear, said third ear having at least one short transverse hollow stud releasably slidingly engaged into said first ear large bore;

(d) a third support end plate, having a fourth ear, said fourth ear having at least one large bore releasably slidingly engaged by said second ear stud; wherein each stud being engaged by a screw member driven into said wall;

(e) at least one and up to two hook members; and (f) anchor means, to releasably anchor said hook member to said first and second plates or to said second and third plates, and defining first rail means, mounted to said hook member, second rail means, mounted to said support member and slidably releasably engaging said first rail means, and stop means to prevent said second rail means from releasing said first rail means upon the load of said article to be hung being applied to said hook member.

It would then be desirable that said hook member be a soap box, said soap box being edgewisely mounted to said support plates, said first rail means being mounted into cavities made into the edge section of said soap box abutting against said plates, the cavities opening downwardly.

A third preferred embodiment of the invention would include an elongated support assembly for hangingly supporting an article against a wall, comprising:

(a) at least two first and second elongated support plates, each defining two opposite ends from which project first and second ears respectively, said first ear having a large bore, said second ear having a short transverse hollow stud;

(b) a third support end plate having a third ear, said third ear having a short transverse hollow stud releasably slidingly engaging said first plate first ear large bore;

(c) a fourth support plate having a fourth ear, said fourth ear having a large bore releasably slidingly engaged by said second plate second ear stud; wherein said at least two plates are endwisely interconnected in pairs by engagement of each remaining ear stud into a corresponding one of said ear bores, whereby said third and fourth plates are positioned at the opposite ends of said elongated support; each stud being further engaged by a screw member to be driven into said wall;

(d) further including at least one and up to (n−1) hook members, where n is the total number of all said support plates; and (e) anchor means, to releasably slidingly anchor a given hook member to a pair of adjacent said plates, and defining first rail means, mounted to said hook member, second rail means, mounted to said support member and slidably releasably engaging said first rail means, and stop means to prevent said second rail means from releasing said first rail means upon the load of said article to be hung being applied to said hook member.

Profitably then, each said support plate would define an inner face, destined to flatly abut against said wall, an outer face, and spacer means to outwardly offset said outer face from said inner face; each said second and third ear being coplanar to the corresponding said plate outer face with the free end of each corresponding stud being coplanar to said plate inner face; each said first and fourth ear being coplanar to the corresponding said plate inner face and being spacedly parallel to the corresponding said second and third ears.

Advantageously, each said first and fourth ear would then include a straight flat outer wall; said second rail means including a tab, outwardly projecting at right angle from each plate outer face adjacent each corresponding ear, and defining straight, flat, parallel, outer and inner walls, this tab inner wall being adjacent to the corresponding ear; each ear outer wall from one plate abutting against said tab inner wall of another adjacent plate when the corresponding said stud engages the associated said large bore; each tab having an outwardly transverse flange at its top end; each said hook member defining an abutment surface provided with a cavity, said cavity defining a downwardly directed mouth and two opposite thicknesswise grooves constituting said first rail means, said grooves being so spaced from each other as to be able to be frictionally slidingly engaged by said outer walls of a pair of proximate said tabs, whereby said hook member abutment surface is flatly slidable along said outer face of the adjacent said plates.

It would also be desirable that said hook member abutment surface grooves be defined by two opposite legs, with each pair of tabs defining a leading edge section, and the tabs being made from a material having some measure of resiliency whereby these tabs are able to slightly bend toward each other upon engagement of each pair of tabs through said cavity mouth, and by a third transverse leg opposite said mouth and against which comes to abut said pair of tabs leading edge section when said pair of tabs are fully engaged into said cavity, said third leg of said cavity constituting said stop means.

Profitably, each tab would define a bevelled edge at said leading edge section, to facilitate engagement of said pair of tabs through said hook member cavity mouth.

DETAILED DESCRIPTION OF THE INVENTION

Figure 1:
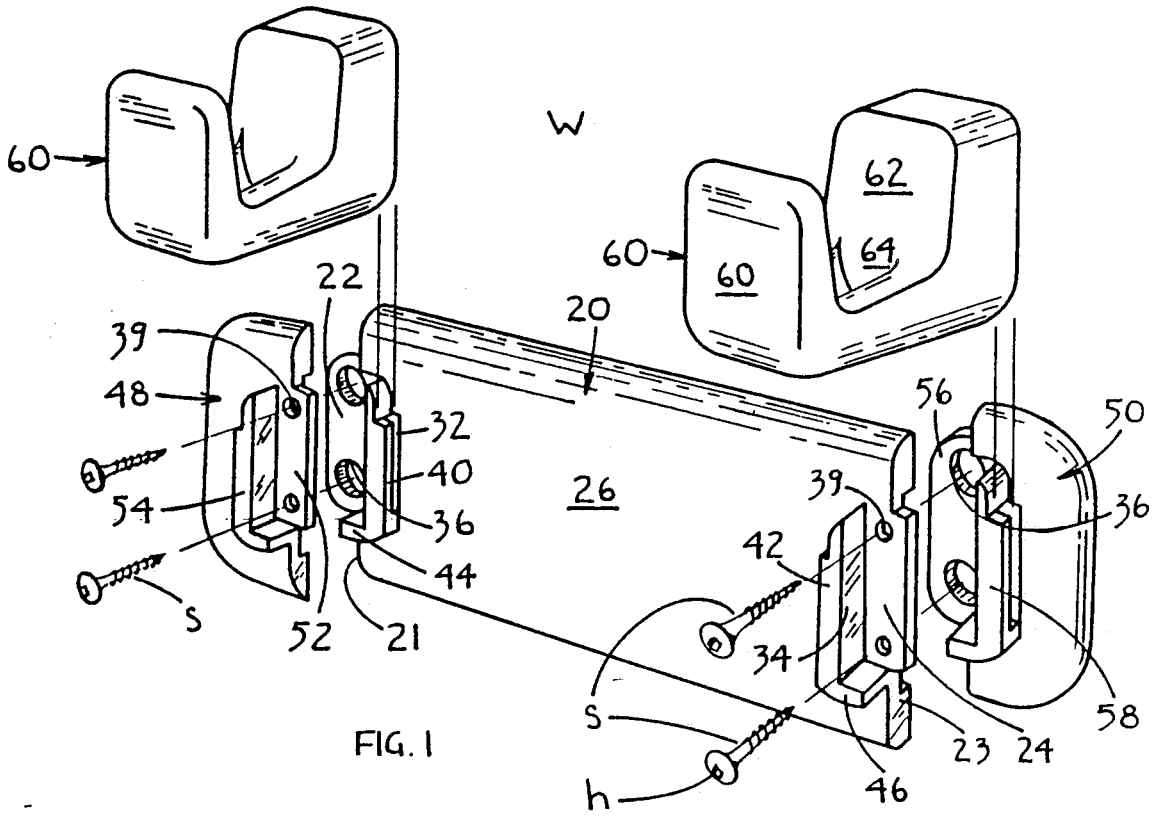
FIGS. 1–2 are perspective exploded views of two ways of mounting the preferred embodiment of the invention.

In FIGS. 1 and 3–6, there is disclosed a generally rectangular support plate 20, provided at its two opposite ends 21, 23 with ear members 22, 24. Rectangular plate 20 defines a main flat body 26, with a flat front face and with rearwardly-turned flanges 28, 30 along the two opposite long edge sections thereof. The free edges of flanges 28, 30 at **28*a*, 30*a* are coplanar and are destined to flatly abut against the wall W of a bathroom or the like, whereby the body 26** remains spacedly outwardly offset from the wall W.

Ear member 22 is half-elliptic, or D-shaped (outwardly convex), being recessed from the front face of body 26 and substantially coplanar with flange edges **28*a*, 30*a* and extending beyond the small end edge 21, about an intermediate section thereof; while ear 24 is rectangular and coplanar with wall 26, and extends about an intermediate section of edge 23. Tabs 32, 34 project forwardly from the interior straight edges of ears 22 and 24, respectively. Ear 22 has two spaced large bores 36, while ear 24 has two spaced downwardly depending short hollow studs, 38, each cylindrical stud from one plate being slidingly engageable into one cylindrical bore 36 from another plate. The bottom free end 38*a* of each stud 38 is coplanar to the plate flanges edges 28*a*, 30*a*. Screws S are destined to engage through the through bore 39 of studs 38 and to be driven into wall W. The front edge of each tab 32, 34 also includes an inturned flange 40, 42 respectively, facing each other and parallel to wall 26 and to ears 22, 24**.

Hence, a number of rectangular plates 20 can be endwisely interconnected in pairs, by the tenon and mortise joint defined by the studs 38 from a first plate 26 and the bores 36 of a second adjacent plate 26 and also defined by the ear 24 of the first plate 26 overlapping the recessed ear 22 of the second plate 26.

Preferably, the external diameter of each cylindrical stud 38 is only very slightly smaller than the inner diameter of cylindrical boring 36, wherein a friction fit engagement of a cylindrical stud 38 in its cylindrical bore 36 is obtained.

Preferably, each tab 32, 34 is thicknesswisely inwardly bevelled at its leading edge end, 32*a*, 34*a*, and both tabs include flanges 44, 46 at the other end which are directed in a direction opposite that of flanges 40, 42 all for a purpose later set forth.

Two smaller end C-shape plates 48, 50, are provided to the opposite ends of the endwise combination of plates 26, if there are more than one, or to the opposite ends of the plate 26, if there is only a single one. End plate 48 includes a projecting ear 52 and associate tab 54 substantially identical to ear 24 and tab 34 of plate 26, while end plate 50 includes a projecting ear 56 and associated tab 58 substantially identical to ear 22 and tab 32 of plate 26. The main body of plates 48, 50, is identical and appears as C-shape, with a peripheral rearwardly-turned flange as for plate 26.

Figure 2:
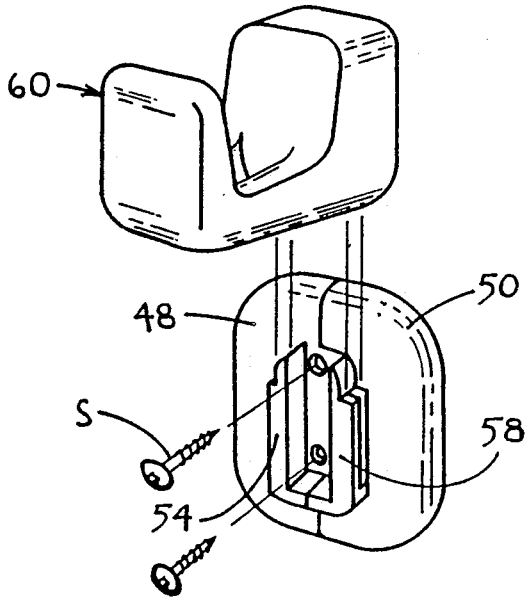
Figure 5:
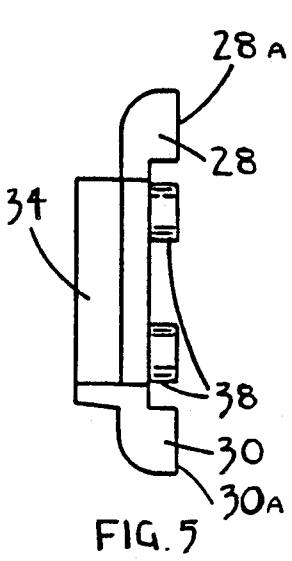
FIGS. 3 to 5 show a top plan view and two end views, respectively, of the rectangular plate of the embodiment of FIG. 1.
Figure 3:
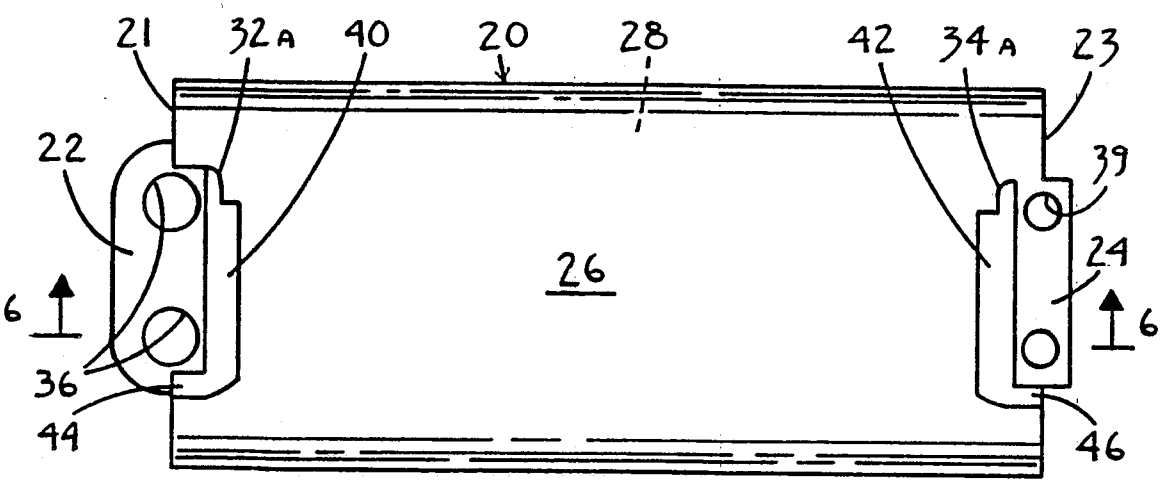
Figure 6:
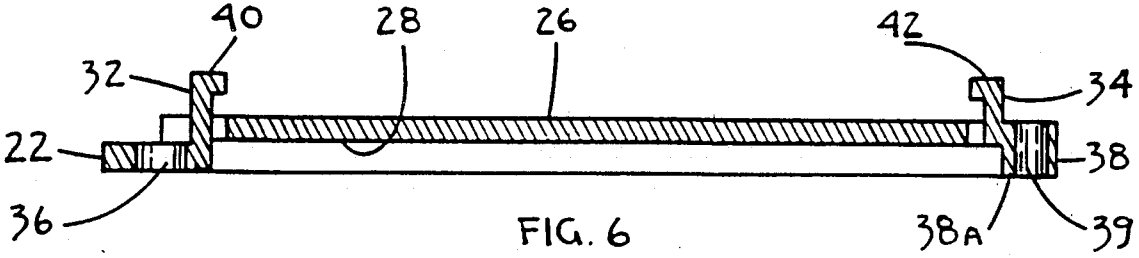
FIG. 6 is a sectional view taken along line 6—6 of FIG. 3.
Figure 4:
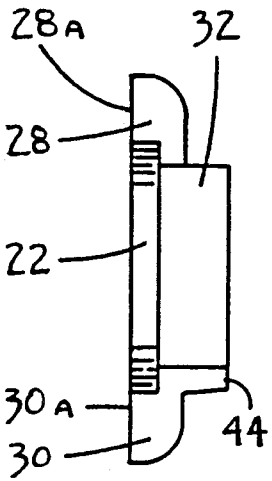
Figure 7:
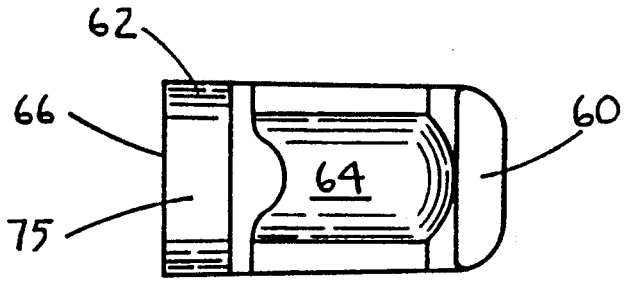
FIGS. 7 to 9 are top, bottom and cross-sectional views of one embodiment of hook bracket shown in perspective in FIGS. 1–3.

As suggested in FIG. 2, as an alternate embodiment, the two end plates 48, 50 could alternately be directly interconnected, since their ears 52; 56 are as complementary as C-plate ear 52 is with rectangular plate ear 22 or as C-plate ear 56 is with rectangular plate ear 24.

The tabs 32, 34 are equally inwardly spaced from joint faces 21, 23 and flanges 44, 46 terminate at said joint faces. When two plates 20 or 48, 50 are assembled or a plate 20 with either one or both plates 50, the tabs 32, 34 form a U-shape ridge which is centrally located relative to the joint 21, 23.

Figure 9:
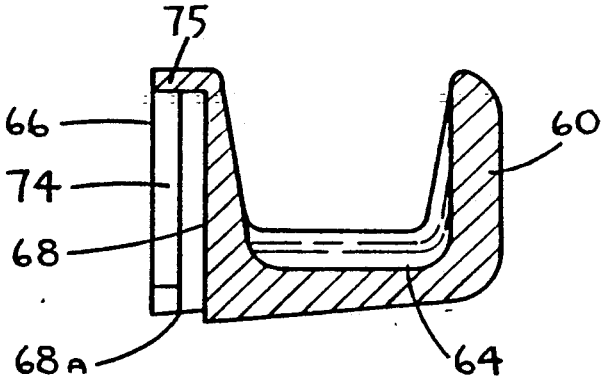
Figure 8:
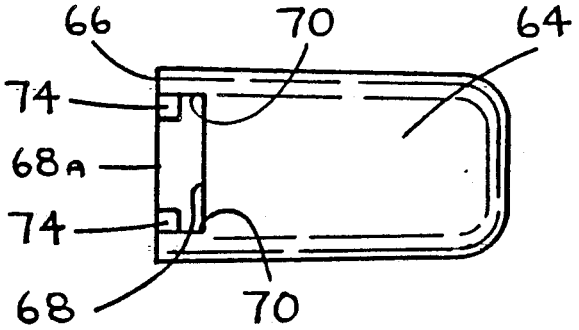

U-shape hooks 60 are further provided, each one to be secured by the U-shaped ridge over one tenon and mortise joint made up of ear studs engaged into ear bores. In FIGS. 1–2 and 6–8, hook 60 is shown to include two side legs 61, 62 and a base leg 64. One side leg 62 defines a back face 66 into which is made a large cavity 68 (FIGS. 8–9). The side walls 70, 72 of cavity 68 are provided with a pair of registering ribs or rails 74, 74 terminating inwardly of the bottom mouth 68*a* of the cavity and joining with a top transverse stop 75 closing the top of cavity 68. The ribs 74, 74 are adapted to slide on the outside of a pair of joined tabs 32, 34 from adjacent support plates and to interlock with flanges 40, 42 of said tabs. The stop 75 comes to rest on the leading, top ends 32*a*, 34*a* of tabs 32, 34.

Flanges 44, 46 of tabs 32, 34 close mouth 68*a* of hook cavity 68.

Figure 10:
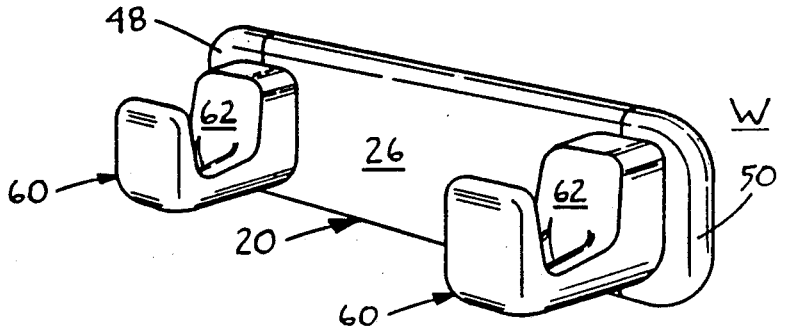
FIG. 10 is a perspective view of the embodiment of FIG. 1 shown assembled.

Hook 60 hides from view the head h of the screws, when engaged by the plate tabs. FIG. 10 shows elements 20, 48, 50 and two hooks 60 completely assembled and fixed or not to a wall W.

Figure 11:
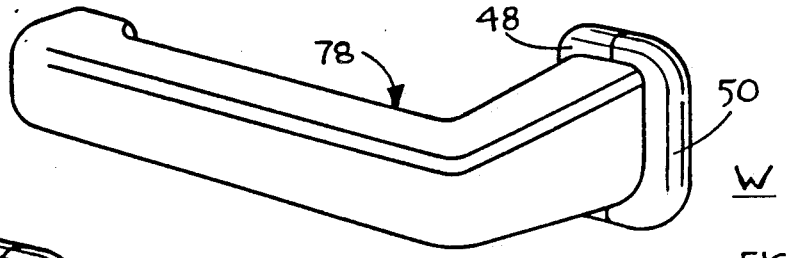
FIGS. 11 to 13 show three other embodiments of hook brackets, namely, a toilet paper roll; a toilet bar, and a soap box.
Figure 12:
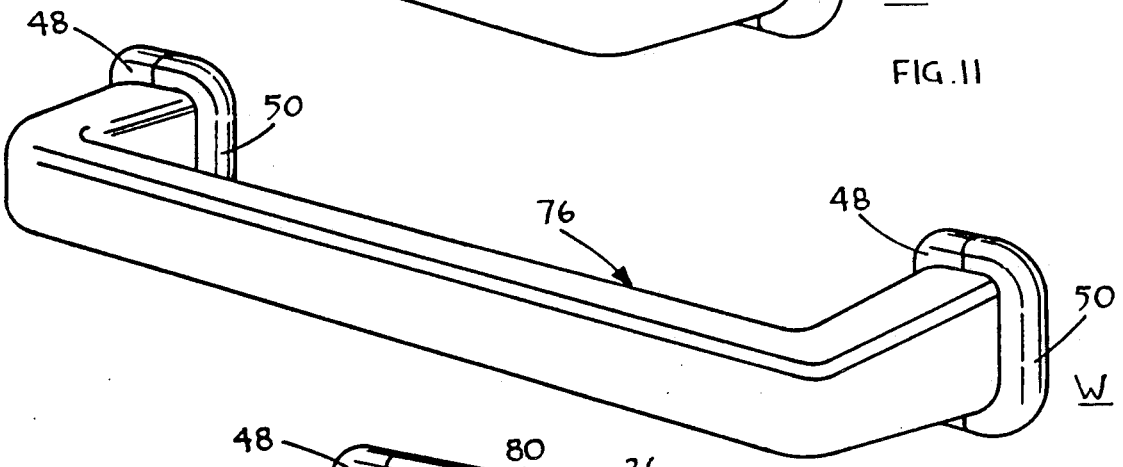
Figure 13:
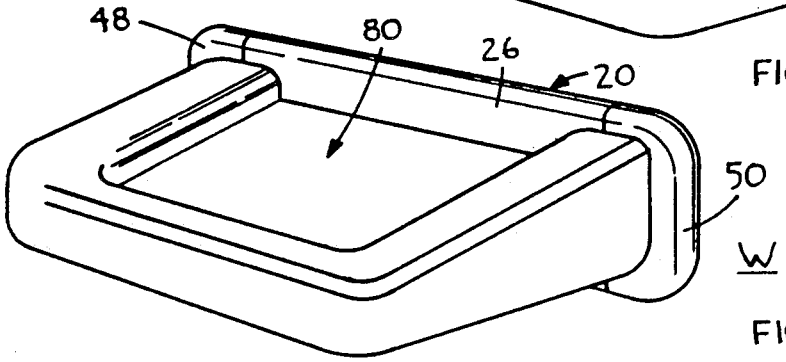

Of course, the hook member could have any other shape: a U-shape toilet bar 76 (FIG. 12), a toilet paper roll holder 78 (FIG. 11), or a soap box 80 (FIG. 13). For a toilet U-bar 76, each end of the side legs thereof include one said cavity and pair of rails, for engagement by two pairs of tabs 54, 58 from two spaced pairs of interconnected C-plates 48, 50. With an L-shape roll holder 78, a single pair of C-plates 48, 50 would be required, wherein the cavity and pair of registering rails would be at the end of the short leg thereof, for engagement by tabs 54, 58. As for the soap box 80, one plate 26 with two end plates 48, 50 could be used, whereby two spaced cavities with associated rails would be mounted to one edge section of the soap box, to be engaged by tabs 40, 54 and 42, 58 respectively for edgewise horizontal mounting of the soap box onto the wall. Again, the mouth of each cavity must be directed downwardly or substantially so, when engaging said tabs, to ensure firm support of the load applied to the hook member.

Any other shape of hook member is well within the scope of the present invention, provided rail means enable suitable releasable connection to wall plates while being capable of sustaining a load without accidentally releasing. The arrangement of interconnected plates can be either a pair of end plates 48, 50; or an elongated plate 26 and two end plates 48, 50; or two or more elongated plates 26 endwisely interconnected to each other with the two C-plates 48, 50 at the opposite end of the assembly. Rectangular plate 26 could of course be of another planar shape, e.g. square or other shape, provided it has two substantially opposite straight edges, one with ear 22 and tab 40, the other with ear 24 and tab 42.

When we refer to a wall, we mean any planar rigid surface, and although the present modular plate and hook assembly is particularly useful for vertical walls, it is obvious that inclined walls, or even a ceiling could be used as a "wall" for anchoring the support plates.

In conclusion, it can be gathered that the system of the invention is completely modular not only for mounting one or more hooks 60 but also for one or more elements 76, 78 or 80, or combinations thereof with or without hooks 60. It requires very thin base plate elements 20, 48, and 50.

It enables quick and effortless manual release of the hook member from the support plate, when not in use, or to change the modular arrangement.

The hook member reinforces the male/female joint by contributing in the anchoring of the two adjacent plates to each other. By hiding the screw heads, the hook member prevents bodily injuries while enhancing the aesthetic appeal of the whole.

What I claim is:

1. A support assembly for hangingly supporting an article against a wall, comprising:

(a) a support member having a through-bore, for passage of a screw member to be driven into said wall for anchoring said support member thereto;

(b) a hook member, for supporting said article; and (c) anchor means, for releasably anchoring said hook member to said support member and coming in register with the head of said screw member to completely cover the latter and defining: first rail means, mounted to said hook member, second rail means, mounted to said support member and slidably releasably engaging said first rail means, and stop means to prevent said second rail means from releasing said first rail means upon the load of said article to be hung being applied to said hook member; wherein said support member includes two support plates, respectively having first and second mating ears, said first ear having at least one short transverse hollow stud, said second ear having at least one large aperture slidably releasably engaged by said stud, the hollow of said stud constituting said support member through-bore.

2. A support assembly as defined in claim 1, wherein said hook member is a U-shape coat-hanger bracket, said first rail means being mounted into a cavity made in one leg of said U-hook member, said cavity defining a mouth opening downwardly.

3. A support assembly as defined in claim 1, wherein said hook member is a generally L-shaped toilet paper support bracket, defining an elongated upstanding leg to be engaged by a roll of toilet paper and a short leg, said first rail means being mounted into a cavity made into the free end of said short leg, said cavity defining a mouth opening downwardly.

4. A support assembly as defined in claim 1, wherein said hook member is a towel supporting bar, of generally U-shape defining an elongated leg and two short legs, there being two said support members, spacedly anchored to said wall, said first rail means being mounted into a cavity made into the free end of each of said short legs, said cavity defining a mouth opening downwardly.

5. An elongated support assembly for hangingly supporting an article against a wall, comprising:

(a) at least two first and second elongated support plates, each defining two opposite ends from which project first and second ears respectively, said first ear having a large bore, said second ear having a short transverse hollow stud;

(b) a third support end plate having a third ear, said third ear having a short transverse hollow stud releasably slidingly engaging into said first plate first ear large bore;

(c) a fourth support plate having a fourth ear, said fourth ear having a large bore releasably slidingly engaged by said second plate second ear stud; wherein said at least two plates are endwisely interconnected in pairs by engagement of each remaining ear stud into a corresponding one of said ear bores, whereby said third and fourth plates are positioned at the opposite ends of said elongated support; each stud being engaged by a screw member to be driven into said wall;

(d) at least one and up to $(n-1)$ hook members where n is the total number of all said support plates; and (e) anchor means, to releasably slidingly anchor a given hook member to a pair of adjacent said plates, and defining first rail means, mounted to said hook member, second rail means, mounted to said support member and slidably releasably engaging said first rail means, and stop means to prevent said second rail means from releasing said first rail means upon the load of said article to be hung being applied to said hook member.

6. A support assembly as defined in claim 5, wherein each said support plate defines an inner face, destined to flatly abut against said wall, an outer face, and spacer means to outwardly offset said outer face from said inner face; each said second and third ear being coplanar to the corresponding said plate outer face with the free end of each corresponding stud being coplanar to said plate inner face; each said first and fourth ear being coplanar to the corresponding said plate inner face and being spacedly parallel to the corresponding said second and third ears.

7. A support assembly as defined in claim 6, wherein each said first and fourth ear includes a straight flat outer wall; said second rail means including a tab, outwardly projecting at right angle from each plate outer face adjacent each corresponding ear, and defining straight, flat, parallel, outer and inner walls, this tab inner wall being adjacent to the corresponding ear; each ear outer wall from one plate abutting against said tab inner wall of another adjacent plate when the corresponding said stud engages the associated said large bore; each tab having an outwardly transverse flange at its top end; each said hook member defining an abutment surface provided with a cavity, said cavity defining a downwardly directed mouth and two opposite thicknesswise grooves constituting said first rail means, said grooves being so spaced from each other as to be able to be frictionally slidingly engaged by said outer walls of a pair of proximate said tabs, whereby said hook member abutment surface is flatly slidable along said outer face of the adjacent said plates.

8. A support assembly as defined in claim 7, with each pair of tabs defining a leading edge section; wherein said hook member abutment surface grooves are defined by two opposite legs, said tabs being made from a material having some measure of resiliency whereby said tabs are able to yieldingly slightly bend toward each other upon engagement of each pair of tabs through said cavity mouth, and by a third transverse leg opposite said mouth and against which comes to abut said pair of tabs leading edge section when said pair of tabs are fully engaged into said cavity, said third leg of said cavity constituting said stop means.

9. A support assembly as defined in claim 8, wherein each tab defines a bevelled edge at said leading edge section, to facilitate engagement of said pair of tabs through said hook member cavity mouth.

10. A support assembly as defined in claim 6, wherein each said stud are of such dimensions as to enable frictional engagement with the corresponding said large bore.

11. A support assembly as defined in claim 5, wherein said third and fourth support plates are generally C-shape.

12. A support assembly as defined in claim 10, wherein said studs are cylindrical, said large bores being also cylindrical.

13. A support assembly for hangingly supporting an article against a wall, comprising:

(a) first and second support plates, each having an integral ear member, the two ear members destined to matingly overlap one another;

(b) a member releasably anchoring said overlapping ear members to said wall;

(c) a hook member, for supporting said article;

(d) first rail means, mounted to said hook member;

(e) second rail means, mounted to said support plates and slidably releasably engaged by said first rail means; and (f) stop means, to prevent said first rail means from releasing said second rail means upon the load of said article to be hung being applied to said hook member;

wherein said support assembly will need very small clearance away from said wall when said hook member is removed from said support plates; and wherein, when said hook member is connected by said rail means to said support plates, said hook member reinforces the joint made by said member anchoring the ear members to the wall, to thus contribute in fixedly securing said adjacent support plates to each other, while concurrently concealing said member anchoring the ear members to the wall.

14. A support assembly as defined in claim 13, wherein said second rail means includes a first flange on one support plate and a second flange on the other support plate, said flanges interlocking with said first rail means when said hook member is connected to said support plates.

15. A support assembly as defined in claim 14, wherein said stop means is integral to said hook member, and will contact said flanges when said rail means engage each other.

* * * * *